US006892647B1

(12) United States Patent
Stone

(10) Patent No.: US 6,892,647 B1
(45) Date of Patent: May 17, 2005

(54) LEAD FREE POWDERED METAL PROJECTILES

(75) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 97 days.

(21) Appl. No.: 09/684,230

(22) Filed: Oct. 6, 2000

Related U.S. Application Data

(63) Continuation-in-part of application No. 09/226,252, filed on Jan. 7, 1999, now Pat. No. 6,691,623, which is a continuation of application No. 08/908,880, filed on Aug. 8, 1997, now Pat. No. 5,917,143.

(51) Int. Cl.[7] ..... F42B 8/14
(52) U.S. Cl. ..... 102/506; 102/517; 102/529
(58) Field of Search ..... 102/506, 507, 102/529, 517, 501

(56) References Cited

U.S. PATENT DOCUMENTS

| | | | | |
|---|---|---|---|---|
| 2,409,307 A | | 10/1946 | Patch et al. | |
| 2,995,090 A | * | 8/1961 | Daubenspeck | 8/196 |
| 3,349,711 A | | 10/1967 | Darigo et al. | |
| 3,363,561 A | | 1/1968 | Irons | |
| 3,463,047 A | | 8/1969 | Shausen | |
| 3,785,293 A | | 1/1974 | Barr et al. | |
| 3,897,732 A | | 8/1975 | Atkins | |
| 3,898,933 A | | 8/1975 | Castera et al. | |
| 3,951,035 A | | 4/1976 | Dautzenberg et al. | |
| 4,428,295 A | | 1/1984 | Urs | |
| 4,958,572 A | | 9/1990 | Martel | |
| 5,264,022 A | | 11/1993 | Haygarth et al. | |
| 5,279,787 A | | 1/1994 | Oltrogge | |
| 5,399,187 A | | 3/1995 | Mravic et al. | |
| 5,527,376 A | | 6/1996 | Amick et al. | |
| 5,760,331 A | | 6/1998 | Lowden et al. | |
| 5,913,256 A | | 6/1999 | Lowden et al. | 75/248 |
| 6,074,454 A | | 6/2000 | Abrams et al. | |
| 6,090,178 A | * | 7/2000 | Benini | 75/245 |
| 6,371,029 B1 | * | 4/2002 | Beal | 102/516 |

FOREIGN PATENT DOCUMENTS

| | | |
|---|---|---|
| CH | 6474 A | 2/1893 |
| DE | 2224925 | 11/1973 |
| GB | 965889 | 8/1964 |
| GB | 2278423 | 11/1994 |
| WO | WO 9411697 | 5/1994 |
| WO | WO 961407 | 1/1996 |
| WO | WO 00/02689 A | 1/2000 |
| WO | WO 01/59399 A | 8/2001 |

* cited by examiner

*Primary Examiner*—Daniel Jenkins
(74) *Attorney, Agent, or Firm*—Womble Carlyle Sandridge & Rice, PLLC

(57) ABSTRACT

Lead free projectiles having a density less than lead, including preferred embodiments comprising a low ductility metal powder and a high ductility metal powder.

10 Claims, No Drawings

LEAD FREE POWDERED METAL PROJECTILES

CROSS-REFERENCE TO RELATED APPLICATION

This is a Continuation-in-Part of application Ser. No. 09/226,252 filed Jan. 7, 1999, now U.S. Pat. No. 6,691,623, which is a Continuation of application Ser. No. 08/908,880 filed Aug. 8, 1997, now U.S. Pat. No. 5,917,143.

BACKGROUND OF THE INVENTION

This invention relates to lead free projectiles. Specifically, this invention relates to lead free projectiles that are significantly less dense than previous lead containing projectiles. More specifically, this invention relates to lead free projectiles that are significantly less dense than previous lead free projectiles, which were designed to approximate the theoretical density of lead.

Because lead is a potential source of environmental problems and health concerns, there is a need for lead free projectiles and ammunition, as well as a method of manufacturing such lead free projectiles and ammunition. Frangible lead free projectiles are useful in indoor shooting ranges, and reduce any potential problems resulting from airborne lead dust, as well as reducing costly environmental cleanup. Non frangible lead free projectiles are useful in hunting and other outdoor activities, especially when such activities occur in environmentally sensitive areas.

Previous lead free projectiles were conceived, designed, configured and manufactured to simulate, as accurately as possible, the theoretical density of lead. Such simulation was previously thought to be desirable so that a shooter would not perceive a great difference between the feel of shooting a projectile containing lead and one that is lead free. For example, in U.S. Pat. No. 5,760,331, Lowden et al. disclose a lead free projectile designed to closely approximate the density of lead by incorporating a denser than lead component and a less dense than lead component.

One solution to the need for lead free projectiles has been the use of a compacted, unsintered admixture of metal particles comprising tungsten and at least one other metal selected from the group of iron and copper. However, the admixture process and the use of tungsten adds to the cost of manufacturing such projectiles.

SUMMARY OF THE INVENTION

The present invention provides lead free projectiles that are not limited by the theoretical density of lead, and thus offers more flexibility in terms of materials used and methods of manufacture. The projectiles of the present invention satisfy the need for lead free projectiles without the expense of high cost materials and processing. The projectiles of the present invention produce a similar "feel" and mimic the ballistic properties of lead projectiles of similar caliber and size, as well as similar lead free projectiles. Specifically, the present invention provides an alternative to lead that is less dense than lead but still retains similar external ballistic properties. In preferred embodiments, the projectiles of the present invention exhibit external ballistic properties similar to previous lead containing and lead free projectiles, especially when fired within ranges of about 100 yards or less.

Specifically, the present invention provides a lead free projectile comprising a compacted admixture of a high ductility metal powder and a low ductility metal powder, wherein the low ductility metal powder is less dense than lead and the projectile is less dense than lead. Alternatively, the present invention provides a lead free projectile having a density less than the theoretical density of lead. The present invention also provides a lead free projectile comprising a compacted admixture of iron powder and at least one powder selected from tin, zinc and alloys and mixtures thereof

DETAILED DESCRIPTION OF THE INVENTION

The projectiles of the present invention, and the processes for manufacturing them, will be more fully understood by reference to the following description. When used herein, projectile includes bullet, shot, and other projectiles associated with firearms. Projectile as used herein include core, which is formed from the compacted metal powders, as well as the jacketed or unjacketed core that can be loaded into a cartridge to form a round of ammunition. Variations and modifications of both the projectiles and the processes can be substituted without departing from the principles of the invention, as will be evident to those skilled in the art.

The projectiles of the present invention comprise a mixture of metal powders, and can comprise lubricants and other materials that aid in the manufacture of such projectiles. The metal powder is a mixture of at least one high ductility metal powder and at least one low ductility metal powder. The high ductility metal powder facilitates cold forming and ease of manufacture of the powder metal mixture into a finished projectile shape by conventional projectile forming technology. The low ductility metal powder reduces the overall cost of the powder metal mixture by acting as a filler that does not sacrifice the material properties of the low ductility metal.

The high ductility metal powder can be a single metal or a mixture of metal powders having high ductility. High ductility as used herein means that the stress-strain characteristic of the material will have an almost indistinguishable transition between elastic and inelastic response regions. Examples of high ductility metal powders that can be used according to the present invention include tin, zinc, copper, aluminum, brass, and to a lesser extent gold and platinum. To the extent that any material used is more dense than lead, the low ductility metal should be less dense than lead. Of the above high ductility metals that can be used, tin and zinc are particularly preferred. The selection of a particular high ductility metal powder or mixture of powders will depend on a variety of factors, including the particular low ductility metal material used, and the ratio of low ductility to high ductility metal powder used in fabricating the projectile. In addition, where the high ductility metal powder comprises a mixture of metal powders, metals with lower ductility may be used in combination with the preferred high ductility metals to form a compact having high ductility.

The density of the high ductility metal powder is preferably less than the theoretical density of lead, however, the density of the high ductility metal powder can be greater than lead if the density of the projectile is less than lead. In addition, if the high ductility metal powder consists of a mixture of powders, the mixture can contain metals of varying density. Again, it is preferred that the density of such mixtures be less than the theoretical density of lead, but the density of the mixture can be greater than lead so long as the composite density of the projectile is less than the theoretical density of lead.

The low ductility metal powder can be a single metal or a mixture of metal powders having low ductility. Low ductility as used herein means that the material will have a well defined transition between elastic and inelastic response regions in the stress-strain characteristic relationship of the material. Examples of low ductility metal powders that can be used according to the present invention include iron, steel, stainless steel and nickel. Of these, iron is particularly preferred. The selection of a particular low ductility metal powder or mixture of powders will depend on a variety of factors, including the particular high ductility metal material used, and the ratio of low ductility to high ductility metal powder used in fabricating the projectile. In addition, where the low ductility metal powder comprises a mixture of metal powders, metals with higher ductility can be used in combination with the preferred low ductility metals to form a mixture having low ductility.

The density of the low ductility metal powder is preferably less than the theoretical density of lead, however, the density of the low ductility metal powder can be greater than lead if the composite density of the projectile is less than lead. In addition, if the low ductility metal powder consists of a mixture of powders, the mixture can contain metals of varying density. Again, it is preferred that the density of such mixtures be less than the theoretical density of lead, but the density of the mixture can be greater than lead so long as the density of the projectile is less than lead.

Regardless of the densities of each of the high and low ductility metal powders, the density of the projectile formed from the powders is preferably less than the theoretical density of lead.

To obtain a projectile of the present invention, it is preferred that the projectile comprise about two parts by volume of high ductility metal powder to one part low ductility metal powder. The preferred ratio ensures that the compacted metal powder mixture will take on properties, including properties such as ductility and formability that aid in the production of projectiles of the present invention, of the powder metal more highly represented in the mixture. The preferred material properties are those of the higher ductility metal powder, and thus it is preferred that the higher ductility metal powder comprise a higher percentage of the mixture.

The projectiles of the present invention can be manufactured by a wide variety of methods. Typically, the projectiles are made by compacting the mixture of metal powders, and then finishing the projectile, if necessary, by sintering, swaging, or otherwise modifying the compacted mixture. Other finishing steps can include jacketing the compacted mixture. Jacketing can be accomplished by a wide variety of known methods. Compacting can be carried out at substantially ambient conditions, without applied heat, or under heated conditions. The method of manufacture will vary depending on a wide variety of parameters, including the desired projectile, the specific composition of the metal powders, the particle size of the metal powders, and other factors that will be obvious to one skilled in the art.

When compacting a mixture of metal powders, it is preferred that the low ductility powder have a pre-compaction particle size distribution of about from 44 to 250 μm. More specifically, a preferred low ductility mixture can have a particle distribution of about 15 to 25% by weight of particles up to about 44 μm, about from 5 to 70% by weight of particles having a particle size of about from 44 to 149 μm, and about from 5 to 15% by weight of particles having a particle size of about from 149 to 250 μm. Even more advantageous is a pre-compaction particle size distribution of about 22% by weight of particles up to about 44 μm, about 68% by weight of particles having a particle size of about from 44 to 149 μm, and about 10% by weight of particles having a particle size of about from 149 to 250 μm. The desired particle size distribution can be determined and obtained through a variety of conventional methods, including optical measurements and sifting. The particles are also available commercially in specific particle size distributions. A preferred high ductility material comprises powder having a pre-compaction particle size distribution of about from 45 to 180 μm. More specifically, a preferred high ductility mixture can have a particle distribution of about 10–14% by weight of particles up to about 45 μm, about from 30–50% by weight of particles having a particle size of about 75 μm about from 20–30% by weight of particles having a particle size of about 106 μm, about from 5–10% by weight of particles having a particle size of about 150 μm, and about from 2–4% by weight of particles having a particle size of about 180 μm. Even more advantageous is a pre-compaction particle size distribution for the low ductility metal of about 14% by weight of particles of about 45 μm, about 48% by weight of particles having a particle size of about 75 μm, about 28% by weight of particles having a particle size of about 105 μm, about 7% by weight of particles having a particle size of about 150 μm, and about 3% by weight of particles having a particle size of about 180 μm.

Some embodiments of the projectile of the present invention may be frangible. Frangible as used herein, consistent with its use in the firearms and ammunition industry, means that the projectile breaks apart completely upon striking a hard target. Frangible lead free projectiles of the present invention can be prepared by a process of manufacture involving only the cold compacting of the high and low ductility metal powders. Non frangible projectiles can be made by cold compacting the metal powders, and can also be made by heat treating the cold compacted metal powders to strengthen the bond between the powders. Frangibility depends, at least in part, on the particle size distribution of the high and low ductility metals used. It has been found to be particularly advantageous to have a pre-compaction particle size distribution of about from 15 to 25% by weight of particles up to about 44 μm, about from 5 to 70% by weight of particles having a particle size of about from 44 to 149 μm, and about from 5 to 15% by weight of particles having a particle size of about from 149 to 250 μm. Even more advantageous is a pre-compaction particle size distribution of about 22% by weight of particles up to about 44 μm, about 68% by weight of particles having a particle size of about from 44 to 149 μm, and about 10% by weight of particles having a particle size of about from 149 to 250 μm. The desired particle size distribution can be obtained through a variety of conventional methods, including optical measurements and sifting. The particles are also available commercially in specific particle size distributions.

Many other particle sizes and particle size distributions can be used to fabricate a projectile of the present invention, including non frangible projectiles. Typically, the particle size of each of the powders can vary, depending on a variety of factors such as the ratio of metal powders, and the ratio of the particle sizes of the metal powders. In addition to the wide variety of particle sizes that can be used, it is preferred that the particles be of irregular shape to promote bonding and strength. It has been found that irregularly shaped particles, when used according to the present invention and when used as components in projectiles of the present invention, improve the bonding of the metal powders and contribute to the green strength of the compacted projectiles, as compared to spherical or regularly shaped particles.

The particle size distributions described above have been found to provide the advantage of integrity of the projectile before and during firing and frangibility upon impact with a target media. While the relationship between particle size distribution and frangibility are not fully understood, it is believed to be a function of the mechanical interlocking of the particles after the cold compaction of the high and low ductility metal powders. In addition, the preferred particle size distribution has been found to provide strength to the compacted composite projectiles of the present invention, and is thought to be one factor enabling the formation of unsintered projectiles of the present invention. By providing such increased robustness and strength, the preferred particle size distribution may provide one factor allowing simplified fabrication of the projectiles of the present invention, involving merely the cold compacting of the metal powders.

The projectiles of the present invention can be manufactured by a process wherein the high and low ductility metal powders of the desired particle sizes are admixed to provide a mixture with the desired ratio of metal powders and if desired, with a desired particle size distribution. The high and low ductility metal powders can also preferably be mixed with one or more lubricants or a mixture of lubricants. A lubricant aids in removing the projectiles from the mold after compaction is complete. If a lubricant is to be added, it can be added to either metal powder or the mixture of metal powders. A preferred lubricant is zinc stearate, which can be used alone or in combination with other lubricants. Up to about 1.0% by weight of zinc stearate can be beneficially added to the mixture of high and low ductility metal powders prior to compaction. About 0.5% has been found to be particularly satisfactory.

The admixture is then placed in a die which is designed to provide the desired shape of the projectile. A wide variety of projectiles can be made according to the present invention, including shot and bullets. The invention is particularly beneficial in bullet manufacture, and especially those having a generally elongated configuration in which a leading end has a smaller circumference than a trailing end.

For both frangible and non frangible projectiles according to the present invention, the mixture of high and low ductility metal powders is cold compacted at a pressure of about from 50,000 to 120,000 psi, with a pressure of about 100,000 psi being particularly preferred. Compacting at a pressure of about 100,000 psi provides the optimal combination of projectile integrity before and during firing and frangibility upon impact with a target. The compaction step can be performed on any mechanical press capable of providing at least about 50,000 psi pressure for a dwell time which can be infinitesimally small. Presently available machinery operates with dwell times of about from 0.05 to 1.5 seconds. Preferably, a conventional rotary dial press is used. A compaction ratio of about 1.8 to 2.3 is preferred. Compaction ratio is used herein in the common sense, meaning that the initial volume of power is compared to the volume of the compacted composite that can form a projectile of the present invention. For non-frangible projectiles, the process may be varied in terms of compaction time or pressure, or the process could further comprise heat treatment such as sintering.

After the projectile is formed by cold compaction, a jacket can be formed around the projectile if so desired. Some embodiments of the projectiles of the present invention do not require jackets. The need to incorporate a jacket into the projectiles of the present invention will depend upon the specific mixture and composition of the metal powders used to fabricate the projectile. In other embodiments, a jacket may be preferred for a variety of reasons. For example, the jacket can isolate the powdered iron material of the projectile from a gun barrel, preventing erosion of the rifling of the gun barrel which might result from direct contact between the interior surface of the barrel and the powdered iron of the projectile. The jacket also helps provide additional integrity of the projectile before and during firing as well as improving the ballistics of the projectile upon firing. The jacket material can be selected from those customarily used in the art, for example, metal or polymeric material. Metals which can be used include aluminum, copper, zinc and combinations thereof, with copper or brass being a preferred choice. Polymeric materials which can be used include polyethylene and polycarbonate, with a low density polyethylene material being preferred.

In the case of metal jackets, the jacket can be applied by any number of conventional processes, including acid or cyanide electroplating, mechanical swaging, spray coating, and chemical adhesives. The preferred method is electroplating.

A variety of electroplating techniques can be used in the instant invention, as will be evident to those in the plating art. In general, the projectiles are cleaned and sealed before the final plating. The sealing can be with impregnating methacrylate and polyester solutions.

In a preferred method of plating, a vacuum impregnation is performed immediately after compaction and prior to electroplating. This impregnation involves infusion of the formed projectile cores in methacrylate material in a large batch type operation. The impregnation step reduces the porosity of the projectiles by filling voids at or near the surface of the projectiles. These voids can contain impurities which might cause corrosion and plate fouling. The impregnation step also provides a barrier to prevent collection of plate bath chemicals in the recesses. Such collected chemicals could leach through the plating, discoloring and changing the dimensions of the bullet.

After sealing the surface of the projectiles, they can be plated with jacketing material to deposit the desired thickness of plating metal on the projectiles. Acid copper plating is preferably used, which is faster and more environmentally friendly than alternative techniques, such as cyanide copper plating. After jacketing, the projectiles can be sized using customary techniques and fabricated into cartridges.

In addition to the protective benefits obtained by adding a jacket to the projectiles of the present invention, the additional mass of the jacket aids in the functionality and reliability of the projectiles when used with semi-automatic and fully automatic firearms. Such firearms require that a minimal impulse be delivered to the gun slide for operation, and the mass added by a jacket (approximately 5–10% increase) can provide enough mass for the use of the projectiles of the present invention with these firearms.

The projectiles of the present invention can have a variety of configurations, including shot and bullets, but are preferably formed into bullets for use with firearms. The bullets can have noses of various profiles, including round nose, soft nose, or hollow point. Either the bullet or the jacket, if so provided, can include a driving band which increases the accuracy of individual bullets and reduces the dispersion of multiple bullets.

The invention is further illustrated by the following specific examples, in which parts and percentages are by weight or volume, as indicated in the Tables. The examples show various projectiles of the present invention, fabricated according to the process described herein. For each of the examples, the frangible projectiles can be made non frangible by heat treatment, for example, sintering. Furthermore, representative projectiles for each of the group of examples were fabricated into 9 mm and .223 caliber bullets, fired and evaluated.

EXAMPLES 1–10

In Examples 1–10, frangible bullets are prepared from blends of high ductility metal powders, namely tin (Sn), and low ductility metal powders, namely iron (Fe), in the weight percentages indicated in Table I. The theoretical density of each blend is determined, and is also reported in Table I. In each Example, the blend has a theoretical density of less than lead. The high ductility metal powder has a particle size distribution of about 14% by weight of particles of about 45 μm, about 48% by weight of particles having a particle size of about 75 μm, about 28% by weight of particles having a particle size of about 105 μm, about 7% by weight of particles having a particle size of about 150 μm, and about 3% by weight of particles having a particle size of about 180 μm. The low ductility metal powder has a particle size distribution of about 22% by weight of particles up to about 44 μm, about 68% by weight of particles having a particle size of about from 44 to 149 μm, and about 10% by weight of particles having a particle size of about from 149 to 250 μm.

The powders are intimately blended with 0.15 weight percent zinc stearate using apparatus conventionally used for the handling of metal powders. The blends are cold compacted at a pressure of 90,000 psi for 0.15 second on a rotary dial press. The bullets are jacketed with copper by electroplating. The bullets are then loaded into cartridges, tested and evaluated, and provide excellent performance characteristics.

EXAMPLES 11–63

In Examples 11–63, the general procedure of Examples 1–10 is repeated, using blends of zinc (Zn) and iron. The specific blends and their theoretical densities are reported in Tables II and III. The resulting bullets are loaded into cartridges and evaluated, and found to provide excellent performance characteristics.

EXAMPLES 64–107

In Examples 64–107, the general procedure of Example 1–10 is repeated, using blends of tin and iron. The specific blends and their theoretical densities are reported in Table IV. The resulting bullets are loaded into cartridges and evaluated, and found to provide excellent performance characteristics.

TABLE I

| Example | Element A<br>Element B<br>VolA/VolB | Sn<br>Fe<br>% Wt. A | Density<br>0.264<br>0.275<br>% Wt. B | Wt A/<br>Wt B | Th Dens<br>(lbm/in^3) |
|---|---|---|---|---|---|
| 1 | 0.50 | 32.43% | 67.57 | 0.480 | 0.2713 |
| 2 | 0.75 | 41.86% | 58.14% | 0.720 | 0.2703 |
| 3 | 1.00 | 48.98% | 51.02% | 0.960 | 0.2695 |
| 4 | 1.50 | 59.02% | 40.98% | 1.440 | 0.2684 |
| 5 | 2.00 | 65.75% | 34.25% | 1.920 | 0.2677 |
| 6 | 3.00 | 74.23% | 25.77% | 2.880 | 0.2668 |
| 7 | 4.00 | 79.34% | 20.66% | 3.840 | 0.2662 |
| 8 | 5.00 | 82.76% | 17.24% | 4.800 | 0.2658 |
| 9 | 6.00 | 85.21% | 14.79% | 5.760 | 0.2656 |
| 10 | 1.94 | 65.06% | 34.94% | 1.862 | 0.2677 |

TABLE II

| Example | Element A<br>Element B<br>VolA/VolB | Zn<br>Fe<br>% Wt. A | Density<br>0.259<br>0.275<br>% Wt. B | Wt A/<br>Wt B | Th Dens<br>(lbm/in^3) |
|---|---|---|---|---|---|
| 11 | 0.50 | 32.01% | 67.99% | 0.471 | 0.2697 |
| 12 | 0.75 | 41.40% | 58.60% | 0.706 | 0.2681 |
| 13 | 1.00 | 48.50% | 51.50% | 0.942 | 0.2670 |
| 14 | 1.50 | 58.55% | 41.45% | 1.413 | 0.2654 |
| 15 | 2.00 | 65.32% | 34.68% | 1.884 | 0.2643 |
| 16 | 3.00 | 73.86% | 26.14% | 2.825 | 0.2630 |
| 17 | 4.00 | 79.02% | 20.98% | 3.767 | 0.2622 |
| 18 | 5.00 | 82.48% | 17.52% | 4.709 | 0.2617 |
| 19 | 6.00 | 84.96% | 15.04% | 5.651 | 0.2613 |
| 20 | 1.94 | 64.63% | 35.37% | 1.827 | 0.2644 |

TABLE III

| | Zinc-Iron Mix | | | | | |
|---|---|---|---|---|---|---|
| Example | % Wt Fe | % Wt Zn | Wt Zn/ Wt Fe | Vol Zn/ Vol Fe | Th Dens | 95% th Dens |
| 21 | 20.00% | 80.00% | 4.000 | 4.2472 | 0.262037 | 0.248935 |
| 22 | 22.00% | 78.00% | 3.545 | 3.7645 | 0.262346 | 0.249229 |
| 23 | 24.00% | 76.00% | 3.167 | 3.3623 | 0.262656 | 0.249523 |
| 24 | 26.00% | 74.00% | 2.846 | 3.0220 | 0.262966 | 0.249818 |
| 25 | 28.00% | 72.00% | 2.571 | 2.7303 | 0.263277 | 0.250114 |
| 26 | 30.00% | 70.00% | 2.333 | 2.4775 | 0.263589 | 0.250410 |
| 27 | 32.00% | 68.00% | 2.125 | 2.2563 | 0.263902 | 0.250707 |
| 28 | 34.00% | 66.00% | 1.941 | 2.0611 | 0.264215 | 0.251005 |
| 29 | 34.61% | 65.39% | 1.889 | 2.0061 | 0.264311 | 0.251096 |
| 30 | 34.62% | 65.38% | 1.889 | 2.0052 | 0.264313 | 0.251097 |
| 31 | 34.63% | 65.37% | 1.888 | 2.0043 | 0.264314 | 0.251099 |
| 32 | 34.64% | 65.36% | 1.887 | 2.0034 | 0.264316 | 0.251100 |
| 33 | 34.65% | 65.35% | 1.886 | 2.0025 | 0.264317 | 0.251102 |
| 34 | 34.66% | 65.34% | 1.885 | 2.0017 | 0.264319 | 0.251103 |
| 35 | 34.67% | 65.33% | 1.884 | 2.0008 | 0.264321 | 0.251104 |
| 36 | 34.68% | 65.32% | 1.884 | 1.9999 | 0.264322 | 0.251106 |
| 37 | 34.69% | 65.31% | 1.883 | 1.9990 | 0.264324 | 0.251107 |
| 38 | 34.70% | 65.30% | 1.882 | 1.9981 | 0.264325 | 0.251109 |
| 39 | 34.71% | 65.29% | 1.881 | 1.9972 | 0.264327 | 0.251110 |
| 40 | 35.00% | 65.00% | 1.857 | 1.9719 | 0.264372 | 0.251154 |
| 41 | 36.00% | 64.00% | 1.778 | 1.8876 | 0.264529 | 0.251303 |
| 42 | 38.00% | 62.00% | 1.632 | 1.7324 | 0.264844 | 0.251602 |
| 43 | 40.00% | 60.00% | 1.500 | 1.5927 | 0.265160 | 0.251902 |
| 44 | 42.00% | 58.00% | 1.381 | 1.4663 | 0.265476 | 0.252203 |
| 45 | 44.00% | 56.00% | 1.273 | 1.3514 | 0.265793 | 0.252504 |
| 46 | 46.00% | 54.00% | 1.174 | 1.2465 | 0.266111 | 0.252806 |
| 47 | 48.00% | 52.00% | 1.083 | 1.1503 | 0.266430 | 0.253108 |
| 48 | 50.00% | 50.00% | 1.000 | 1.0618 | 0.267749 | 0.253412 |
| 49 | 52.00% | 48.00% | 0.923 | 0.9801 | 0.267070 | 0.253716 |
| 50 | 54.00% | 46.00% | 0.852 | 0.9045 | 0.267390 | 0.254021 |
| 51 | 56.00% | 44.00% | 0.786 | 0.8343 | 0.267712 | 0.254327 |
| 52 | 58.00% | 42.00% | 0.724 | 0.7689 | 0.268035 | 0.254633 |
| 53 | 60.00% | 40.00% | 0.667 | 0.7079 | 0.268358 | 0.254940 |
| 54 | 62.00% | 38.00% | 0.613 | 0.6508 | 0.268682 | .0255248 |
| 55 | 64.00% | 36.00% | 0.562 | 0.5973 | 0.269007 | 0.255557 |
| 56 | 66.00% | 34.00% | 0.515 | 0.5470 | 0.269332 | 0.255866 |
| 57 | 68.00% | 32.00% | 0.471 | 0.4997 | 0.269659 | 0.256176 |
| 58 | 70.00% | 30.00% | 0.429 | 0.4551 | 0.269986 | 0.256487 |
| 59 | 72.00% | 28.00% | 0.389 | 0.4129 | 0.270314 | 0.256798 |
| 60 | 74.00% | 26.00% | 0.351 | 0.3731 | 0.270643 | 0.257111 |
| 61 | 76.00% | 24.00% | 0.316 | 0.3353 | 0.270972 | 0.257424 |
| 62 | 78.00% | 22.00% | 0.282 | 0.2995 | 0.271303 | 0.257738 |
| 63 | 80.00% | 20.00% | 0.250 | 0.2654 | 0.271634 | 0.258052 |

TABLE IV

| | Tin-Iron Mix | | | | | |
|---|---|---|---|---|---|---|
| Example | % Wt Fe | % Wt Zn | Wt Zn/ Wt Fe | Vol Zn/ Vol Fe | Th Dens | 95% th Dens |
| 64 | 20.00% | 80.00% | 4.000 | 4.1710 | 0.265900 | 0.252605 |
| 65 | 22.00% | 78.00% | 3.545 | 3.6970 | 0.266119 | 0.252814 |
| 66 | 24.00% | 76.00% | 3.167 | 3.3020 | 0.266340 | 0.253023 |
| 67 | 26.00% | 74.00% | 2.846 | 2.9678 | 0.266560 | 0.253232 |
| 68 | 28.00% | 72.00% | 2.571 | 2.6813 | 0.266782 | 0.253442 |
| 69 | 30.00% | 70.00% | 2.333 | 2.4331 | 0.267003 | 0.253653 |
| 70 | 32.00% | 68.00% | 2.125 | 2.2158 | 0.267225 | 0.253864 |
| 71 | 34.00% | 66.00% | 1.941 | 2.0241 | 0.267447 | 0.254075 |
| 72 | 34.21% | 65.79% | 1.923 | 2.0053 | 0.267470 | 0.254097 |
| 73 | 34.22% | 65.78% | 1.922 | 2.0044 | 0.267471 | 0.254098 |
| 74 | 34.23% | 65.77% | 1.921 | 2.0035 | 0.267472 | 0.254099 |
| 75 | 34.24% | 65.76% | 1.921 | 2.0026 | 0.267474 | 0.254100 |
| 76 | 34.25% | 65.75% | 1.920 | 2.0018 | 0.267475 | 0.254101 |
| 77 | 34.26% | 65.74% | 1.919 | 2.0009 | 0.267476 | 0.254102 |
| 78 | 34.27% | 65.73% | 1.918 | 2.0000 | 0.267477 | 0.254103 |
| 79 | 34.28% | 65.72% | 1.917 | 1.9991 | 0.267478 | 0.254104 |
| 80 | 34.29% | 65.71% | 1.916 | 1.9982 | 0.267479 | 0.254105 |
| 81 | 34.30% | 65.70% | 1.915 | 1.9973 | 0.267480 | 0.254106 |
| 82 | 34.31% | 65.69% | 1.915 | 1.9964 | 0.267481 | 0.254107 |
| 83 | 35.00% | 65.00% | 1.857 | 1.9365 | 0.267558 | 0.254180 |
| 84 | 36.00% | 64.00% | 1.778 | 1.8538 | 0.267669 | 0.254286 |
| 85 | 38.00% | 62.00% | 1.632 | 1.7013 | 0.267892 | 0.254498 |
| 86 | 40.00% | 60.00% | 1.500 | 1.5641 | 0.268116 | 0.254922 |
| 87 | 42.00% | 58.00% | 1.381 | 1.4400 | 0.268339 | 0.254922 |
| 88 | 44.00% | 56.00% | 1.273 | 1.3271 | 0.268563 | 0.255135 |
| 89 | 46.00% | 54.00% | 1.174 | 1.2241 | 0.268788 | 0.255348 |
| 90 | 48.00% | 52.00% | 1.083 | 1.1296 | 0.269012 | 0.255562 |
| 91 | 50.00% | 50.00% | 1.000 | 1.0427 | 0.269238 | 0.255776 |
| 92 | 52.00% | 48.00% | 0.923 | 0.9625 | 0.269463 | 0.255990 |
| 93 | 54.00% | 46.00% | 0.852 | 0.8883 | 0.269689 | 0.256205 |
| 94 | 56.00% | 44.00% | 0.786 | 0.8193 | 0.269915 | 0.256419 |
| 95 | 58.00% | 42.00% | 0.724 | 0.7551 | 0.270142 | 0.256635 |
| 96 | 60.00% | 40.00% | 0.667 | 0.6952 | 0.270369 | 0.256850 |
| 97 | 62.00% | 38.00% | 0.613 | 0.6391 | 0.270596 | .0257067 |
| 98 | 64.00% | 36.00% | 0.562 | 0.5865 | 0.270824 | 0.257283 |
| 99 | 66.00% | 34.00% | 0.515 | 0.5372 | 0.271510 | 0.257500 |
| 100 | 68.00% | 32.00% | 0.471 | 0.4907 | 0.271281 | 0.257717 |
| 101 | 70.00% | 30.00% | 0.429 | 0.4469 | 0.271510 | 0.257934 |
| 102 | 72.00% | 28.00% | 0.389 | 0.4055 | 0.271739 | 0.258152 |
| 103 | 74.00% | 26.00% | 0.351 | 0.3664 | 0.271969 | 0.258370 |
| 104 | 76.00% | 24.00% | 0.316 | 0.3293 | 0.272199 | 0.258589 |

TABLE IV-continued

| | Tin-Iron Mix | | | | | |
|---|---|---|---|---|---|---|
| Example | % Wt Fe | % Wt Zn | Wt Zn/ Wt Fe | Vol Zn/ Vol Fe | Th Dens | 95% th Dens |
| 105 | 78.00% | 22.00% | 0.282 | 0.2941 | 0.272430 | 0.258808 |
| 106 | 80.00% | 20.00% | 0.250 | 0.2607 | 0.272660 | 0.259027 |

I claim:

1. A lead free projectile comprising a compacted admixture of about one part by volume iron powder and about two parts by volume of at least one powder selected from tin, zinc and alloys and mixtures thereof, and wherein the compacted admixture has a density less than 70% of the theoretical density of lead.

2. A projectile of claim 1 wherein the iron powder consists essentially of particles of about from 44 to 250 microns.

3. A projectile of claim 1 wherein the at least one powder selected from tin, zinc and alloys and mixtures thereof consists essentially of particles of about from 45 to 180 microns.

4. A projectile of claim 1 wherein the iron powder and the at least one powder selected from tin, zinc and alloys and mixtures thereof consist essentially of particles of about from 44 to 250 microns.

5. A projectile of claim 1 wherein the volume ratio of the at least one powder selected from tin, zinc and alloys and mixtures thereof to the iron powder is about from 0.5 to 6.

6. A projectile of claim 1 wherein the at least one powder is tin, the volume ratio of tin to iron is about 0.5, and the projectile has a theoretical density of about 0.2713 lbm/cubic inch.

7. A frangible projectile of claim 1.

8. A sintered projectile of claim 1.

9. An unsintered projectile of claim 1.

10. A projectile of claim 1 having a theoretical density of about from 0.26 to 0.28 lbm/cubic inch.

* * * * *